US011143215B2

(12) United States Patent
Schaber

(10) Patent No.: US 11,143,215 B2
(45) Date of Patent: Oct. 12, 2021

(54) METHOD AND APPARATUS FOR CLEANING AND/OR REPLACING HYDRAULIC OIL IN HYDRAULIC DRIVES

(71) Applicant: VOITH PATENT GMBH, Heidenheim (DE)

(72) Inventor: Hubert Schaber, Rutesheim (DE)

(73) Assignee: Voith Patent GmbH, Heidenheim (DE)

( * ) Notice: Subject to any disclaimer, the term of this patent is extended or adjusted under 35 U.S.C. 154(b) by 151 days.

(21) Appl. No.: 16/323,423

(22) PCT Filed: Jul. 28, 2017

(86) PCT No.: PCT/EP2017/069162
§ 371 (c)(1),
(2) Date: Feb. 5, 2019

(87) PCT Pub. No.: WO2018/024632
PCT Pub. Date: Feb. 8, 2018

(65) Prior Publication Data

US 2019/0195250 A1 Jun. 27, 2019

(30) Foreign Application Priority Data

Aug. 5, 2016 (DE) ..... 102016214560.6

(51) Int. Cl.
*F15B 21/041* (2019.01)
*F15B 21/00* (2006.01)
*F15B 21/044* (2019.01)

(52) U.S. Cl.
CPC ..... *F15B 21/041* (2013.01); *F15B 21/005* (2013.01); *F15B 21/044* (2013.01); *F15B 2211/615* (2013.01)

(58) Field of Classification Search
CPC .... F15B 21/041; F15B 21/044; F15B 21/005; F15B 2211/615; F15B 2211/655; F15B 2211/611; B60T 17/222
USPC ..... 60/584
See application file for complete search history.

(56) References Cited

U.S. PATENT DOCUMENTS 1,825,013 A * 9/1931 Patton ..... B60T 17/222 188/352
2,295,539 A * 9/1942 Beach ..... B60T 17/222 188/352
2,425,848 A * 8/1947 Vawter ..... B01D 29/00 210/167.31
3,394,812 A * 7/1968 Cohen ..... B64F 1/36 210/134
3,536,081 A * 10/1970 Riess ..... B08B 9/0323 134/22.12
3,538,682 A * 11/1970 Chattin ..... F15B 21/044 96/193

(Continued)

FOREIGN PATENT DOCUMENTS

| | | | |
|---|---|---|---|
| CN | 2628734 | Y | 7/2004 |
| EP | 2829740 | A1 | 1/2015 |
| WO | 2008089217 | A2 | 7/2008 |

*Primary Examiner* — Dustin T Nguyen
(74) *Attorney, Agent, or Firm* — Laurence A. Greenberg; Werner H. Stemer; Ralph E. Locher

(57) ABSTRACT

A flushing module for hydraulic drives, in particular for self-contained drives, for cleaning and/or replacing hydraulic medium. The flushing module has a pump and at least one shutoff valve and a housing. The flushing module is portable.

3 Claims, 11 Drawing Sheets

(56) References Cited

U.S. PATENT DOCUMENTS 3,889,904 A * 6/1975 Jones ..... B64F 5/60 244/104 R
4,390,049 A * 6/1983 Albertson ..... B08B 9/0323 123/41.42
6,189,319 B1 * 2/2001 Petty ..... B60T 17/222 60/453
6,207,051 B1 * 3/2001 Anderson ..... B01D 46/2411 210/237
6,302,167 B1 * 10/2001 Hollub ..... B60T 17/221 141/65
6,796,339 B1 * 9/2004 Petty ..... B60T 17/222 141/59
6,830,083 B1 * 12/2004 Hollub ..... B60T 17/222 141/59
6,979,397 B2 * 12/2005 Evanovich ..... B01D 35/143 134/169 A
7,281,551 B2 * 10/2007 Mengelt ..... B60T 17/222 141/59
7,357,161 B2 * 4/2008 Flournoy ..... B60T 17/222 141/302
7,546,842 B2 * 6/2009 Llorente Gonzalez ..... F01M 11/04 134/111
7,846,342 B2 12/2010 Johnson et al.
7,993,530 B2 * 8/2011 Horne ..... B01D 35/26 210/767
8,109,364 B2 * 2/2012 Phillips ..... F16N 37/00 184/1.5
8,215,343 B2 * 7/2012 Murphy ..... B60T 17/222 141/98
9,429,231 B2 8/2016 Uenishi
2009/0101551 A1 * 4/2009 Liao ..... F15B 21/005 210/94
2011/0031195 A1 * 2/2011 Wilkinson ..... B08B 9/0325 210/790

* cited by examiner

METHOD AND APPARATUS FOR CLEANING AND/OR REPLACING HYDRAULIC OIL IN HYDRAULIC DRIVES

BACKGROUND OF THE INVENTION

Field of the Invention

The invention relates to a method and an apparatus for flushing hydraulic drives.

Self-contained linear actuators are known in the art, for example under the name CLDP or SHA. These self-contained servo-hydraulic linear actuators, also referred to as linear axes, hydraulic drives or linear drives, consist substantially of series components of the electrical and hydraulic systems. They combine all the familiar functions of servo drives with the physical advantages of fluid technology such as high power density and robustness. The standardized hydraulic cylinder, control block and motor-pump unit subassemblies make up the basic structure of modular linear actuators. These linear actuators have their own closed fluid circuit and do not require a central hydraulic unit. The leak-free fluid circuit is able to function with a very small quantity of hydraulic fluid. Such linear actuators are usually completely pre-assembled, and have already been filled with the hydraulic fluid and started up when they are delivered.

Due to the compact design, the hydraulic medium is not easy to replace.

SUMMARY OF THE INVENTION

The objective of the invention is to provide an apparatus and a method by which the hydraulic medium may comfortably be cleaned and/or replaced, particularly in self-contained servohydraulic drives.

The invention has the further objective of providing an apparatus for cleaning and/or replacing the hydraulic medium, the apparatus being portable. This also simplifies handling in particular.

The solution according to the invention is characterized by the features of the independent claims. Advantageous configurations are set forth in the dependent claims.

Advantageously, it has proven to be the case that improving the quality of the hydraulic medium also improves the operational life of self-contained hydraulic drives.

This improvement may take place as part of servicing. The service may be performed by dedicated maintenance staff or specially trained personnel. It has proven to be advantageous if the maintenance apparatus, known as a flushing module, is portable. This makes it possible to carry the flushing module to the hydraulic drive that will be serviced. An apparatus is considered portable in this context if two people are able to carry it.

In a particularly advantageous configuration, the flushing module is configured compactly, so that this apparatus may in particular be transported in a station wagon. An example of typical dimensions is length: 700 mm, width: 500 mm and height: 550 mm.

It has proven advantageous for the flushing module to comprise a pump, at least one shutoff valve and a housing, the housing preferably being furnished with at least one recess for accommodating at least one container for hydraulic fluid. It is particularly advantageous if this recess is configured both for accommodating a first hydraulic container for new hydraulic fluid and for accommodating an additional hydraulic container for used hydraulic fluid. For accommodating the hydraulic container, a recess, or two separate recesses arranged separately from one another, may be provided. The hydraulic connections may be connected to the hydraulic containers during transport and in this way may be protected against contamination. Alternatively, the hydraulic connections may be provided with a transport guard by which the connections are protected against contamination. In an advantageous development, it is envisioned that each hydraulic container may hold a volume of at least 10 liters, preferably 20 liters.

In an advantageous embodiment of the flushing module, it is envisioned that the flushing module has at least one carrying handle, preferably two carrying handles. The carrying handles support straightforward carrying of the flushing module. Preferably, the two carrying handles are arranged on two opposite sides of the flushing module.

In a preferred embodiment, it is provided that the flushing module has an accessory receptacle. This may simplify handling. All parts required for flushing may be carried along with the flushing module. The only exception is that it may possibly still be necessary to carry a hydraulic container next to the flushing module.

In a further preferred embodiment, it is provided that the flushing module comprises at least one first shutoff valve and one additional shutoff valve. As a result, different modes of operation are possible. If only one shutoff valve is provided, then, for example, the flushing module may be bled and hydraulic fluid may also be replaced. One, or also two, hydraulic containers may be used. If at least one filter is provided in the hydraulic line, the at least one filter may also clean the hydraulic oil. If an additional valve is provided, further operating modes are possible. For example, bleeding and merely filtering may be performed without replacing hydraulic oil. In a preferred embodiment, three shutoff valves are provided. Numerous operating modes are possible as a result, and some of the possible operating modes are described in detail below, with reference to the following exemplary embodiments.

In a preferred embodiment, the flushing module comprises a manometer to adjust a pressure. In this way, the hydraulic oil may be supplied under a predetermined pressure. Furthermore, it may be provided that a predetermined pressure is set in the hydraulic drive, which may depend on the operating position of the hydraulic drive.

In a particularly preferred embodiment, a filter indicator is furnished for the at least one filter. Preferably, a filter is respectively provided in a supply line and also in a discharge line. In a particularly preferred embodiment, the filters are stored in the housing and are visible from the outside, including while the flushing module is operating, without any need to disassemble the flushing module. In this way, the condition of the at least one filter may be checked easily. The filter may easily be replaced by releasing it from the housing.

In a preferred embodiment of the flushing module, the hose connections that may be connected to the hydraulic containers are fixedly connected to the flushing module. As a result, it may be ensured that the hose connections are always kept together with the flushing module.

In a particularly preferred embodiment, it is provided that at least those hose connections that lead to the oil containers consist of a transparent hose. As a result, the hydraulic oil, contamination and gas components may be checked visually.

In a preferred embodiment, it is provided that the flushing module has a maximum weight of 45 kg, preferably 35 kg. This weight value refers to the flushing module without hydraulic containers. Thus, the flushing module may be carried comfortably by two people. The flushing module may be equipped with hydraulic containers in advance, while it is being transported.

In a variant of a preferred embodiment, the flushing module is provided with rollers for comfortable transport.

A further objective of the invention has been to provide a method by which hydraulic medium may easily be cleaned and/or replaced.

Method for cleaning or replacing the hydraulic fluid of a hydraulic drive with a flushing module according to one of the foregoing Claims [sic], comprising the following method steps:

Bleeding the flushing module

Connecting the flushing module to the hydraulic drive

Filtering and/or replacing hydraulic fluid.

Preferably, in order to achieve a particularly good result in terms of the quality of the hydraulic medium, first a bypass filtering and then replacement of hydraulic fluid is performed. For bypass filtering, it is envisioned that the flushing module is set to a preload pressure. Preferably, the flushing module is set to a preload pressure between the time when it is bled and the time when it is connected.

In a preferred method, before the flushing module is bled, it is first equipped with the required hydraulic containers.

In a preferred development of the method, it is envisioned that the hydraulic drive is flooded with fresh hydraulic oil. "Flooding" here means that in the hydraulic lines that are connected to the hydraulic drive, a preload pressure is intentionally not set.

In a preferred embodiment, the hydraulic drive is flushed. For flushing, a pressure is set in the supply lines that are connected to the hydraulic drive. In a preferred embodiment, a pressure adjustment valve is provided for performing this pressure adjustment. Preferably, the pressure adjustment valve is arranged after the first shutoff valve and the hydraulic container. Preferably, the pressure set during flushing is less than the predetermined preload pressure of the hydraulic drive by at least one bar, preferably at least 1.5 bar. As a maximum, the pressure provided by the pressure adjustment valve during flushing is a maximum of 2.5 bar less than the predetermined preload pressure. For flushing, a first shutoff valve is opened and hydraulic fluid of the hydraulic drive is filtered by a pump of the flushing module, and preferably a filter is provided in the activated hydraulic circuit. The at least one filter further contributes to the purity of the hydraulic fluid introduced into the hydraulic drive. Preferably, at least two filters are furnished, and one of the filters is arranged in the supply line while the second filter is arranged in the discharge line.

In a preferred development of the method, the flushing module is connected to the hydraulic drive in order to filter the hydraulic fluid. Bypass filtering may also be performed during normal operation. Bypass filtering takes place while working strokes are being performed during normal operation. In this case, the flushing module may be connected to the hydraulic drive for a plurality of hours. In a filtering identified as bypass filtering, new oil is not supplied. It is not contemplated, in this event, that the lines of the flushing module would be filled with new hydraulic oil.

Time-optimized bypass filtering may be performed, but time-optimized bypass filtering is not performed during normal operation. In time-optimized bypass filtering, it is provided that a predetermined preload pressure is set in the flushing module. The preload pressure set at the flushing module preferably corresponds to the preload pressure of the hydraulic drive, with a maximum deviation of +/−1 bar, preferably at most +/−0.5 bar and particularly preferably +/−0.2 bar. In the case of time-optimized bypass filtering, the pump pumps the hydraulic oil of the hydraulic drive through the filters of the flushing module, and the hydraulic drive is operated at reduced speed and with strokes that are as long as possible. "Reduced speed" refers to a speed ranging between 80% of the maximum speed and 10% of the maximum speed. In a preferred method, a reduced speed is used that is 70% to 60% of the maximum speed of the hydraulic drive. "Long strokes," in the case of time-optimized bypass flushing, refers to strokes ranging between 90% of the maximum stroke and 95% of the maximum stroke. In a preferred method, during filtering, strokes are performed in the range of 90 to 95%.

The method steps envisioned in a preferred method for replacing hydraulic fluid using a flushing module are as follows:

Draining hydraulic fluid

Flooding with fresh hydraulic fluid

Setting a reduced preload pressure

Flushing with hydraulic fluid

Setting a predetermined preload pressure

Disconnecting the flushing module

In this case, it is preferably possible to shut off a supply line to the hydraulic drive as well as to shut off the discharge line for the hydraulic drive. In the supply line, hydraulic oil flows to the hydraulic drive, and in the discharge line, hydraulic fluid flows from the hydraulic drive into a hydraulic container connected to the flushing module. When replacing hydraulic oil, the flushing module does not require preloading. In a preferred method, flushing with hydraulic fluid is carried out for at least 5 minutes, preferably at least 10 minutes.

When using a flushing module with only two shutoff valves, it may be necessary to change the discharge from a used oil container to a fresh oil container.

In a preferred method, it is provided that during flooding and flushing, the inlet and the return of the hydraulic drive are connected to the first hydraulic container via the flushing module.

In a preferred embodiment of the method, before connecting the flushing module to the hydraulic drive, the flushing module is bled; hose connections intended for connecting to the hydraulic drive are connected to the flushing module, and these hose connections are connected to each other at the ends that are furnished respectively for connecting to the hydraulic drive, and an inlet and outlet are connected to an oil container that has been filled with new oil. By bleeding the flushing module before connecting to the hydraulic drive, the risk of introducing gaseous volume the hydraulic drive is limited or minimized.

In a preferred embodiment of the method, the hydraulic lines for connecting to the hydraulic drive are stowed in the flushing module after maintenance has been performed, such as filtering or replacing the hydraulic fluid of the hydraulic drive. In this way, it is achieved that all components required for maintenance may be carried along with the flushing module. However, to reduce the weight, it may be provided that hydraulic containers that have been filled for transport are replaced with for empty containers, and the filled hydraulic containers are transported separately. In a further development, it may also be provided that the connections of the hydraulic supply lines are protected against contamination. For this purpose, caps or a connection to hydraulic containers may be furnished.

BRIEF DESCRIPTION OF THE SEVERAL VIEWS OF THE DRAWING

The invention will be described in more detail below, with reference to exemplary embodiments. These exemplary embodiments are not intended to be limiting. The drawings show as follows.

DESCRIPTION OF THE INVENTION

Figure 1:
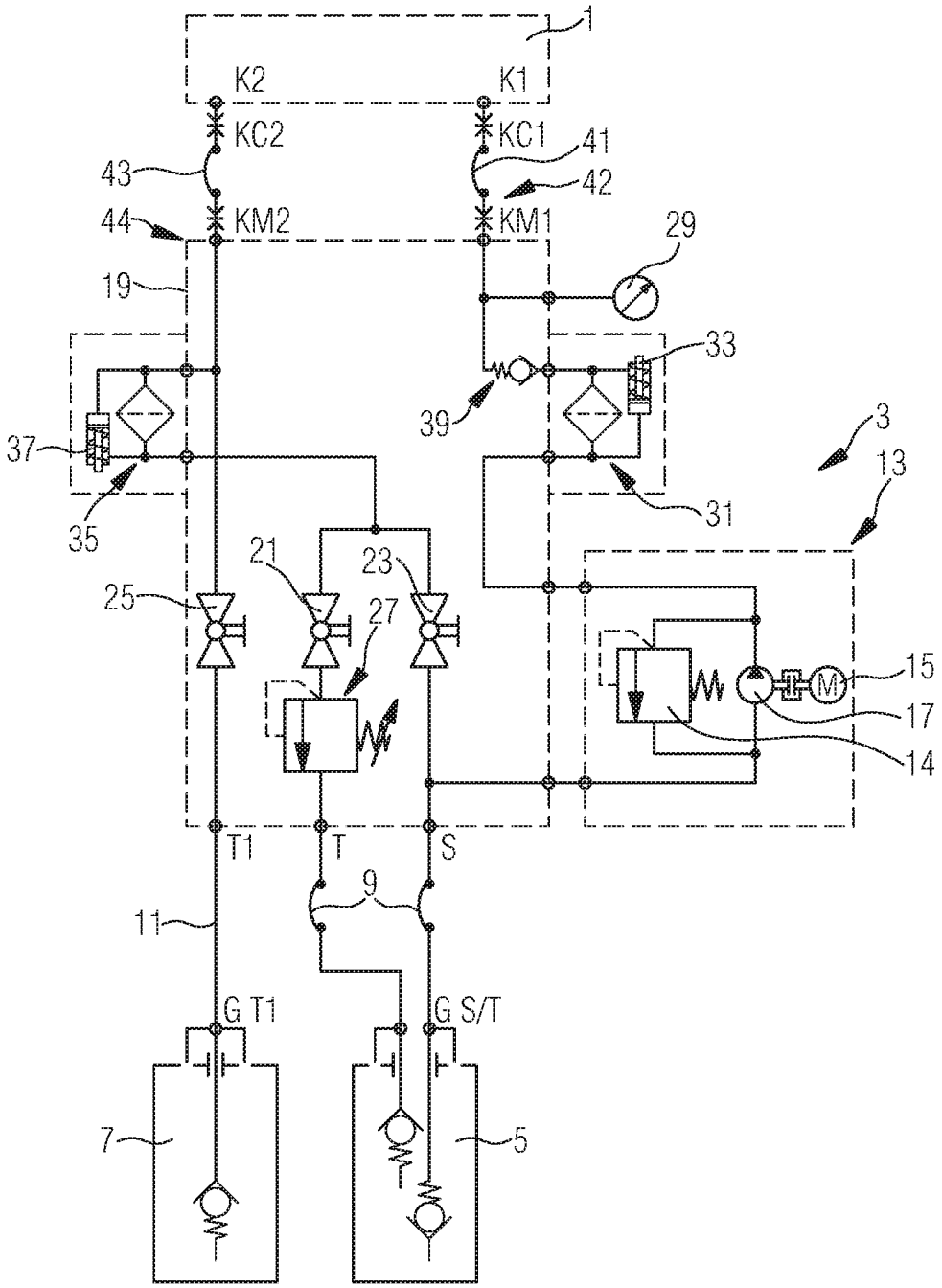
FIG. 1: Flushing module connected to a hydraulic drive; hydraulic circuit diagram

The general structure will first be described, with reference to FIG. 1. The flushing module 3 has a motor-pump assembly 13 comprising a pump 17. The pump 17 is driven by a motor 15, and in particular by an electric motor 15. Parallel to the pump 17, a valve 14 is arranged for pressure protection, so that in the case of a defect, a buildup of pressure over a predetermined amount is prevented. The flushing module has a valve-filter unit 19. In the embodiment shown, this valve-filter unit 19 comprises a first shutoff valve 21 and a second shutoff valve 23 and a third shutoff valve 25. These shutoff valves 21, 23, 25 are shown in parallel in the hydraulic diagram. The flushing module 3 is provided with a manometer 29 and a pressure adjustment valve 27, so that a preload pressure may be set. By means of the valves 21, 23, 25, various hydraulic connections may be provided either through or in the flushing module. For some operating modes, only a portion of the valves 21, 23, 25 are required, as explained below.

The flushing module provides a supply line 42 from a first hydraulic container 5 to a hydraulic drive 1, in particular a self-contained hydraulic drive. The flushing unit is designed in particular for use in hydraulic drives having a filling volume of up to 5 liters of hydraulic fluid. If the filling volume is greater, cleaning or replacement may be performed with another oil container or a larger oil container.

The supply line 42 extends from G S/T to KC1. A filter 31 is arranged in the supply line. The filter in the supply line 42 has a filter indicator 33. A discharge 44, also referred to as a return, extends from KC2 to GT1. A filter 35 is arranged in the return 44. This filter 35 is also furnished with a filter indicator 37. A hose connection inlet 41 and a hose connection return 43 is furnished for connecting the flushing module 3 with the hydraulic drive 1. The hose connection inlet extends from fitting KM1 on the flushing module 3 to fitting K1 of the hydraulic drive 1. The hose connection return 43 extends from fitting KM2 on the flushing module to fitting K2 on the hydraulic drive. These hose connections may be firmly connected to KM1 and KM2 on the side of the flushing module. It may also be provided that the hose connections 41, 43 are detachably connected to the flushing module 3. In detachable connection, a required hose length of the hose connections 41, 43 is selected, and an accessory receptacle 59 is brought along that is provided in a housing 65 of the flushing module 3. In addition to the hose connections 41, 43, an adapter 57 may also be carried in the accessory receptacle 59. In addition, a check valve 39 is arranged in the supply line 42. In the illustrated embodiment, a connection is provided to the first hydraulic container 5 for new oil and to the second hydraulic container 7 for waste oil, by means of a flushing assembly—new oil 9 and a flushing assembly—waste oil 11. The flushing assemblies 5, 7 are fixedly connected to the flushing module 3.

Figure 2:
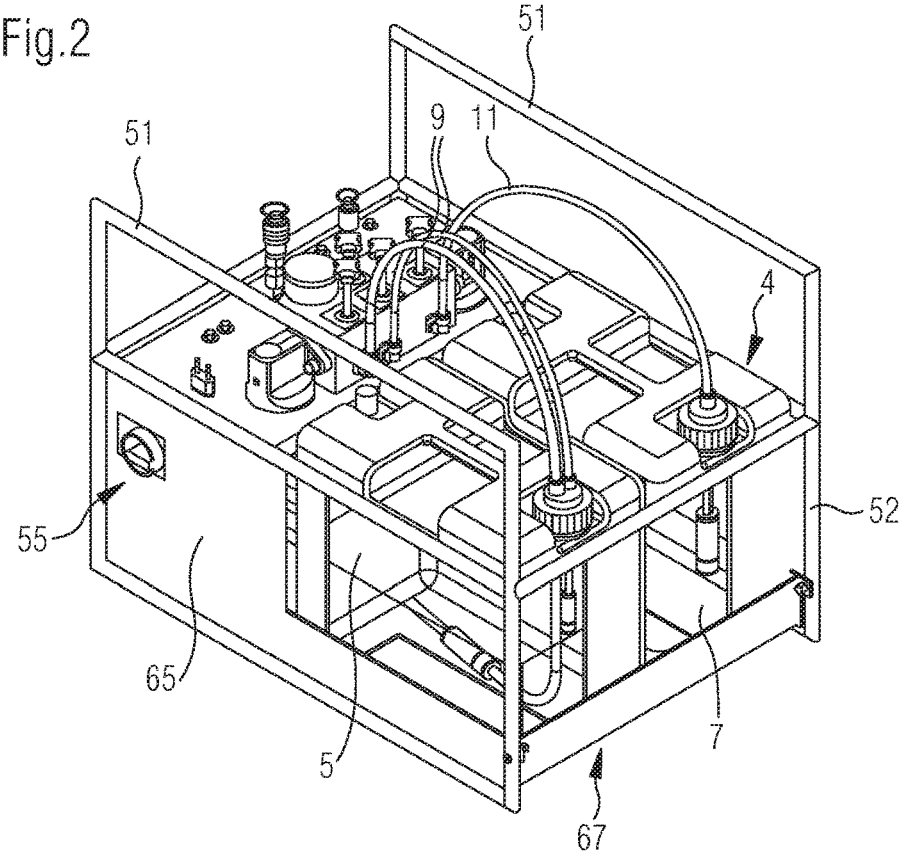
FIG. 2: Flushing module equipped with two hydraulic containers
Figure 3:
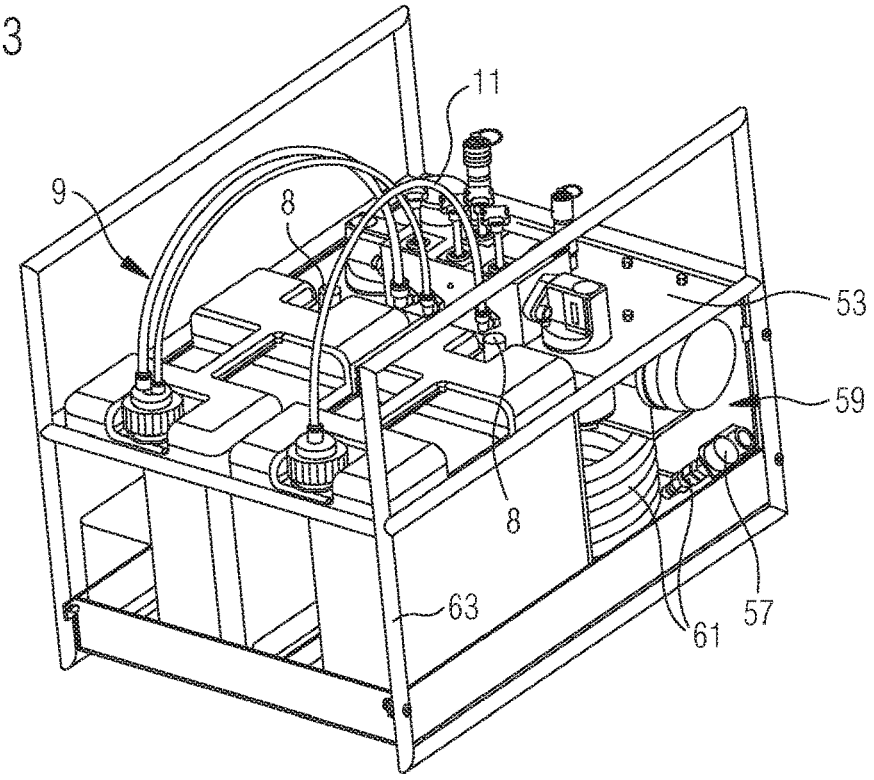
FIG. 3: Flushing module with accessory compartment

FIG. 2 and FIG. 3 show a three-dimensional representation of a flushing module that has a structure as shown in FIG. 1. The flushing module has two carrying handles, on both sides. The carrying handles 51 are part of a frame 63. A housing 65 is held by the carrying frame. However, a housing 65 may also be provided that is firmly connected to carrying handles, in which case a frame is dispensed with. The housing 65 comprises a housing base 67 and a cover 53. On one side of the flushing module, a main switch 55 is provided, for switching the flushing module 3 on and off. This main switch 55 could also be arranged on the upper cover 53. The shutoff valves 21, 23, 25 and the pressure adjustment valve 27 may be operated from the upper cover 53. The manometer 29 is arranged in the region of the upper cover so as to be visible. Thus, these controls are easily accessible and may be operated comfortably. In addition, these control elements are protected by the carrying handles 51. In the illustration of FIG. 3, the accessory compartment is visible, in which hose connections 41, 43 and an adapter 57 are mounted as accessories 61.

Various operating modes of the flushing module shown in FIG. 1 will be described below.

Process Step "Prepare Flushing Module":

Before the flushing module 3 is connected to a hydraulic drive 1, the flushing module 3 is prepared:

- The flushing module 3 is placed at a suitable location near the CLDP. It is important to ensure a safe placement of the flushing module 3 and sufficient room for operation.
- The shutoff valves 21, 23, 25 (red star grip) on the flushing module 3 are closed (screw in completely).
- Pressure valve 27 (black star grip) is opened (screw out completely).
- The flushing module 3 is equipped with the first hydraulic container 5, "fresh oil," and the new oil flushing assembly 9 is connected to the hydraulic container 5 (GS/T).
- The flushing module 3 is equipped with the "waste oil" oil container 7, and the corresponding "return assembly" 11 is connected to the second hydraulic container 7 (GT1).
- A respective ventilation cover 8 is opened at both hydraulic containers.
- The existing connecting hoses 41, 43 are coupled to the flushing module 3 via the quick couplings KM1 and KM2.
- The connecting hoses 41, 43 are short-circuited; for this purpose, the two hose couplings KC1 and KC2 are connected to one another, FIG. 4.
- The power supply to the flushing module 3 is provided via a power plug.

Process Step "Bleeding Flushing Module & Connecting Hoses" (FIG. 4):

The "external flushing" shutoff valve 21 is opened. Shutoff valves 23, 25 remain closed.

The pressure valve 27 for setting a preload pressure remains completely open.

The flushing module 3 is switched on at the main switch.

In this state, the flushing module 3 and the connecting hoses 41, 43 are flooded with new oil and bled.

At the new oil flushing assembly 9 GS/T, it is checked whether hydraulic oil is flowing free of bubbles through the transparent suction and return lines. This flushing is provided over a predetermined period, preferably at least 5 minutes.

The pressure valve 27 for adjusting a preload pressure is set to the preload pressure of the hydraulic drive. If this predetermined preload pressure is reached, the flushing module is operated at this pressure for at least one additional minute.

The flushing module 3 is then turned off at the main switch 55.

The shutoff valve 21 on the flushing module 3 is again closed.

The "Bleeding flushing module & connecting hoses" process step has been completed.

"Coupling Flushing Module" Process Step (FIG. 1):

The flushing module is connected to the hydraulic drive.

The shutoff valves 21, 23 and 25 on the flushing module 3 must be shut off.

The connecting hoses 41, 43, which were short-circuited at the hose couplings KC1 and KC2, are separated.

Hose coupling KC1 is connected to the hydraulic drive 1 with coupling K1

Hose coupling KC2 is connected to coupling K2 at the hydraulic drive.

The preload pressure must be checked on the manometer. The preload pressure must be identical to the preload pressure of the hydraulic drive.

The "Couple flushing module 3" process step is completed.

Adapters may be necessary for the various models of hydraulic drives 1. For example, there are hydraulic drives that are equipped with a cooling module, with differing hydraulic connections. An intermediate adapter may be used for coupling the flushing module 3.

Figure 6:
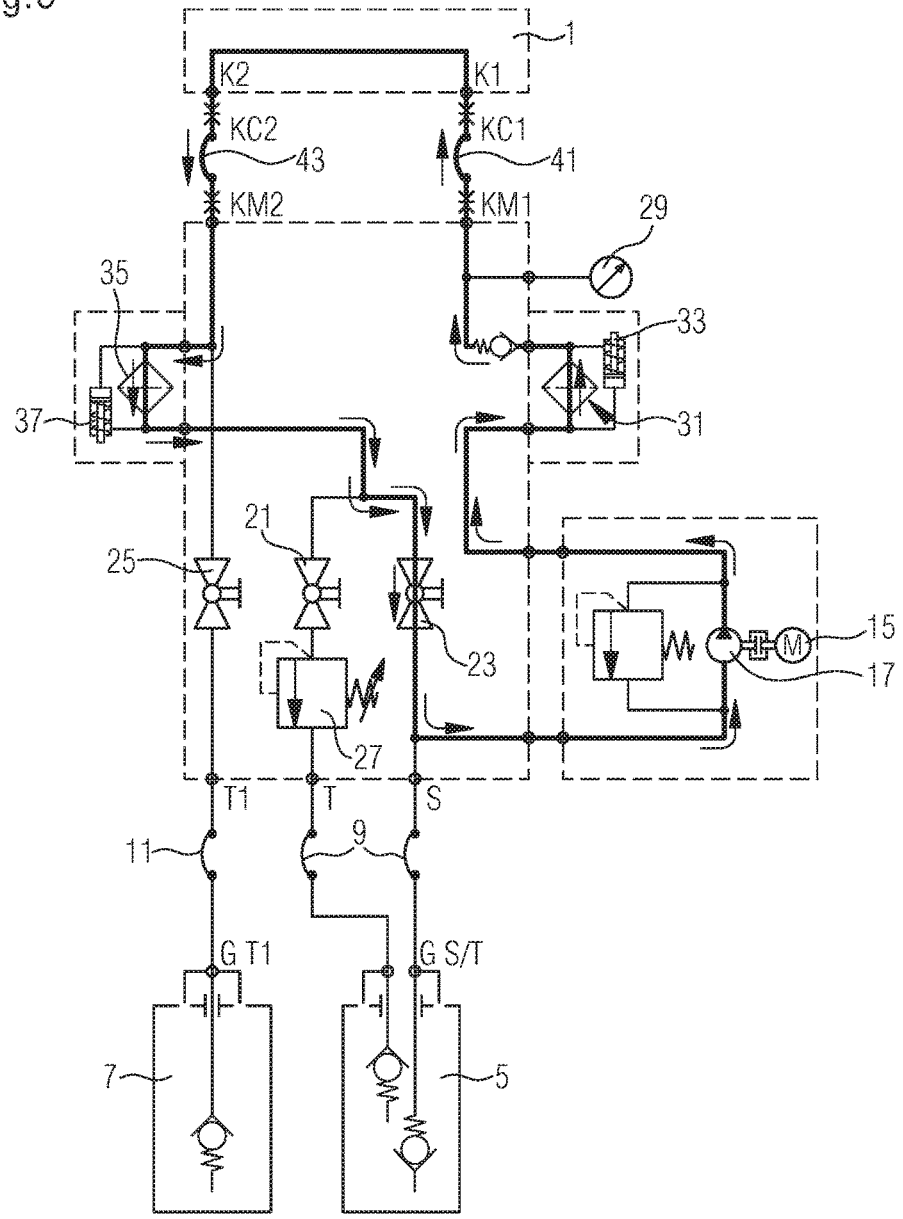
FIG. 6: Flushing module in "bypass filtering" operating mode

"Bypass Filtering" Process Step (FIG. 6):

The shutoff valve 23 (internal flushing) is opened on the flushing module 3.

The preload pressure is checked on the manometer 29. The previously-set preload pressure should be maintained.

The flushing module 3 is switched on via the main switch. The hydraulic circuit for bypass filtering—without new oil supply—is provided.

In parallel with this, the hydraulic drive is activated and operated at a reduced speed with strokes that are as long as possible. Strokes are considered "as long as possible" that are in the range of 90% to 95% of the maximum stroke. This flushing and cleaning process runs for a predetermined period of time. Continuing this flushing and cleaning process for at least 20 minutes, preferably 30 minutes, has proven advantageous in the case of self-contained hydraulic drives with a maximum hydraulic volume of 2 liters.

The hydraulic drive 1 is switched off in the retracted end position, approx. 0 to 5 mm before the end stop of the hydraulic drive.

The flushing module 3 is switched off via the main switch 55.

The shutoff valve 23 (internal flushing) of the flushing module 3 is closed.

The process step of "bypass filtering" the hydraulic drive is completed.

Figure 7:
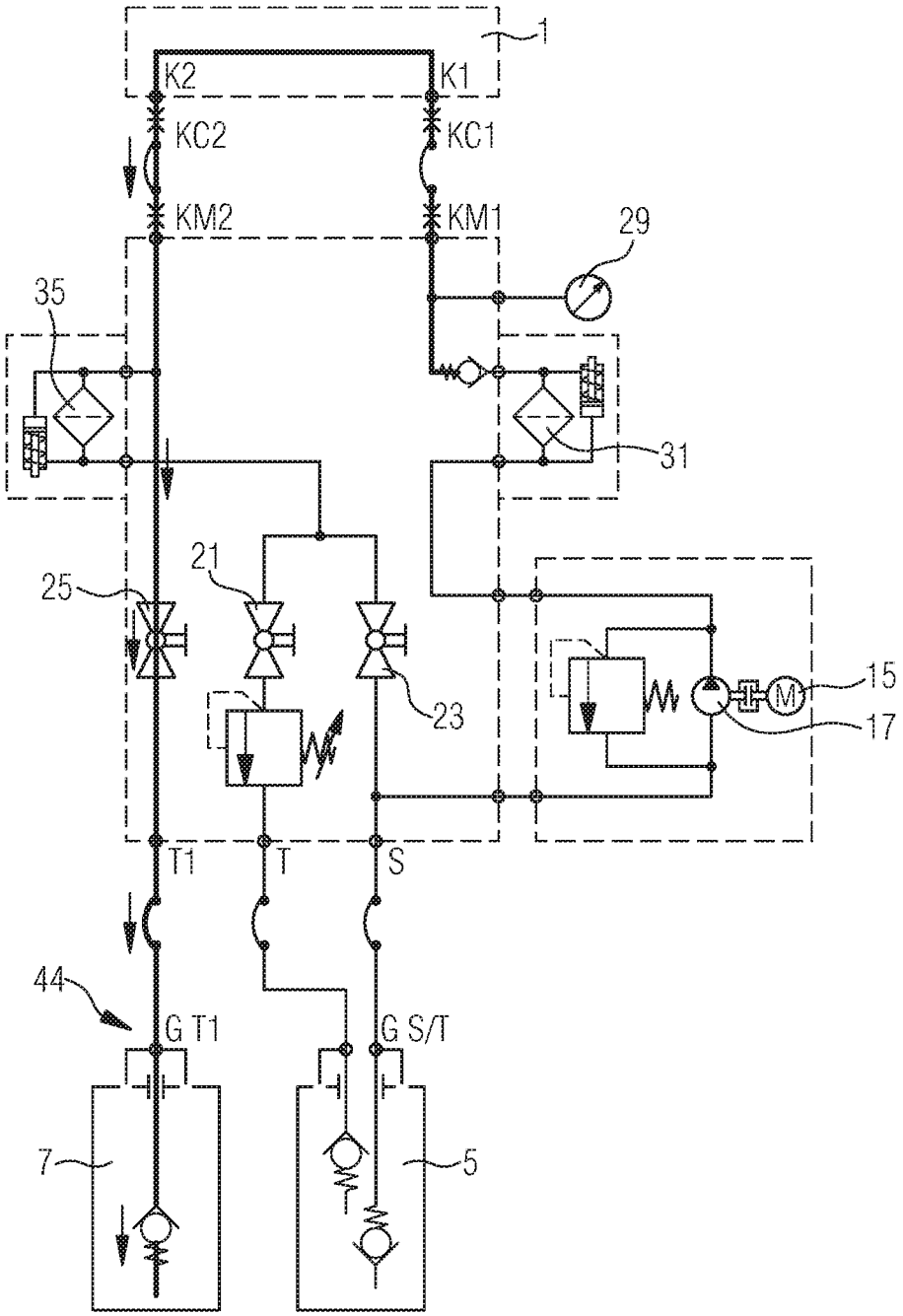
FIG. 7: Flushing module in operating mode "draining oil"

"Drain Waste Oil" Process Step, FIG. 7:

The flushing module 3 and hydraulic drive must be switched off, and the shutoff valves 21, 23 and 25 on the flushing module 3 must be shut off.

The connection of the flushing assembly 11 with the connection GT1 to the second hydraulic container 7 are checked. The ventilation cover 8 on the second hydraulic container 7 must be open.

The third shutoff valve 25 on the flushing module 3, "oil change", is opened slowly.

Waste oil is drained into the second hydraulic container 7 via fitting T1. This relieves the system preload pressure.

The system preload pressure is checked on the manometer 29. The system is depressurized by means of the flushing module.

The third shutoff valve 25 on the flushing module, "oil change," is closed again.

The "drain waste oil" process step is completed.

In this phase, the nitrogen preloading of the pressure accumulator may be checked using a correspondingly suitable test apparatus, and may be corrected if it deviates from the target pressure!

Figure 8:
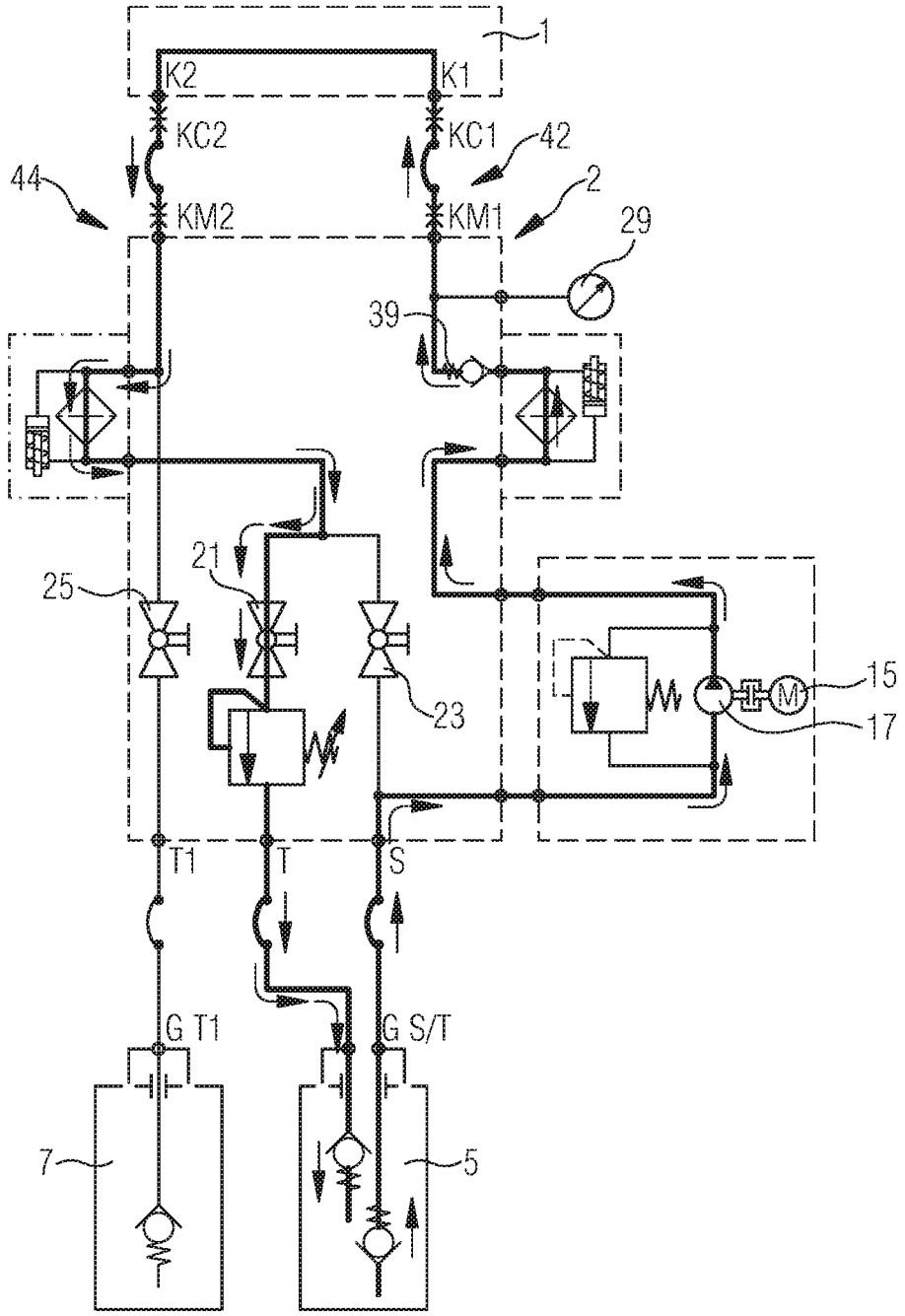
FIG. 8: Flushing module in "filling fresh oil" operating mode

"Flood Fresh Oil" Process Step (FIG. 8):

The flushing module 3 and the hydraulic drive 1 must be switched off, and the shutoff valves 21, 23 and 25 must be shut off at the flushing module.

The connection between the new oil flushing assembly 9 and the fitting GS/T on the first hydraulic container, which holds fresh oil, is checked.

The ventilation cover 8 on the first hydraulic container 5 is open.

The shutoff valve 21, "external flushing," on the flushing module 3 is opened.

The "preload pressure" pressure adjustment valve 27 "preload pressure" is completely open.

The flushing module 3 is switched on at the main switch. Via the transparent suction and return lines at the flushing assembly 9 GS/T, it may be checked whether the hydraulic oil is flowing without bubbles. In a self-contained hydraulic drive with a total volume of 5 liters of hydraulic fluid, it has proven sufficient to operate in this operating mode for about 1-2 minutes.

"Flush Fresh Oil" Process Step (FIG. 8):

The pressure adjustment valve 27 is slowly set to a reduced "system pressure".

A reduced standard preload pressure, reduced by 1.5 bar, was generated. The standard preload pressure is predetermined in relation to the hydraulic drive.

The hydraulic drive 1 is operated at a greatly reduced speed, about 10% V max., and with strokes that are as long as possible. The longest possible strokes are in the range of 80 to 90% of the maximum stroke of the hydraulic drive. In this case, the preload pressure will fluctuate.

The duration of the flushing process is at least 10 minutes.

The "Fresh oil—flush" process step is completed.

Process Step "Adjustment of Preload Pressure":

the hydraulic drive 1 is moved to the retracted end position and switched off.

The predetermined preload pressure of the hydraulic drive is set to the predetermined setpoint for preload pressure, at the "preload pressure" of the pressure adjustment valve 27.

The flushing module 3 is switched off at the main switch.

The shutoff valve 21 on the flushing module 3, "external flushing," is closed.

Process step "Adjustment of preload pressure" is completed.

In the event that no oil change is intended and only the preload pressure must be corrected, the preload pressure may be adjusted directly in process step 4, "Bypass filtering".

"Decouple the Module" Process Step:

Disconnect hose connections 41, 43 from the hydraulic drive 1 at connection points KC1 and KC2 (quick couplings).

The coupling plug on the flushing module, and the coupling connections of the hydraulic hose connections 41, 43, are closed using dust caps.

The system preload pressure at the hydraulic drive 1 is checked.

The hydraulic drive 1 is checked for leaks.

Process step 8, "Uncouple module", is completed.

"Prepare Flushing Module for Storage" Process Step:

To properly store the flushing module or prepare it for the next use, two clean oil canisters are required. The "fresh oil" used for filling (including flushing) is mixed with "waste oil" to a certain extent. For this reason, this oil should not be used for further refillings. The waste oil should be disposed of appropriately.

The power plug is disconnected from the power supply.

The shutoff valves 21, 23 and 25 are closed, and the pressure adjustment valve 27 is opened.

The hose connections 41, 43 are disconnected from the flushing module by means of the quick couplings KM1 and KM2, and the corresponding coupling plugs are closed with dust caps. Hoses are stored in the accessory receptacle of the flushing module.

The second hydraulic container 7, "waste oil", is removed from the flushing module and replaced with a clean empty container for waste oil. Inside this empty container, the flushing assembly 11 return GT1 is protected against contamination.

The first hydraulic container 5 for "new oil" is removed from the flushing module and replaced with a clean empty container. The flushing assembly new oil with suction and return GS/T is protected from contamination inside the empty container.

Figure 9:
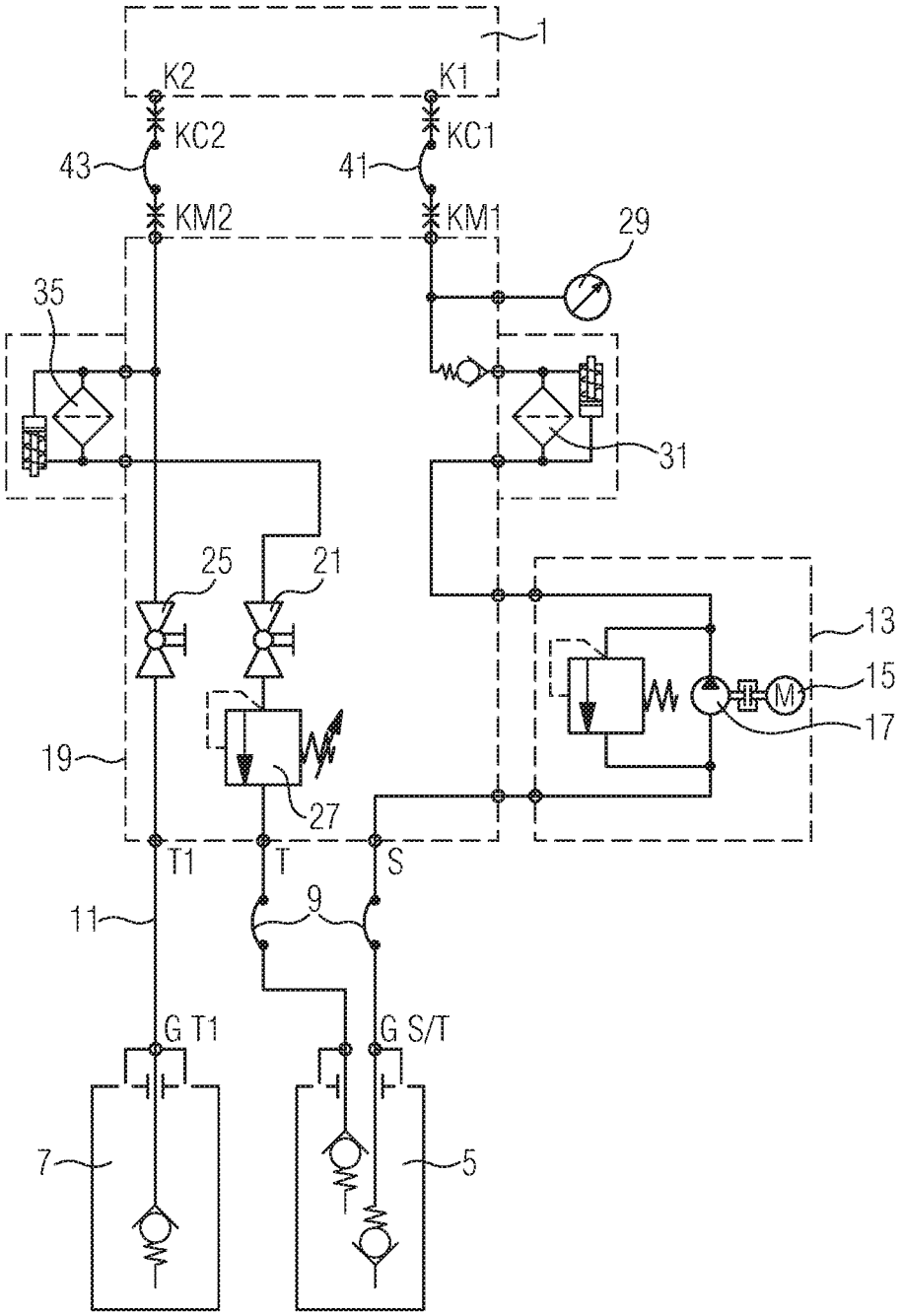
FIG. 9: Flushing module with two shutoff valves
Figure 10:
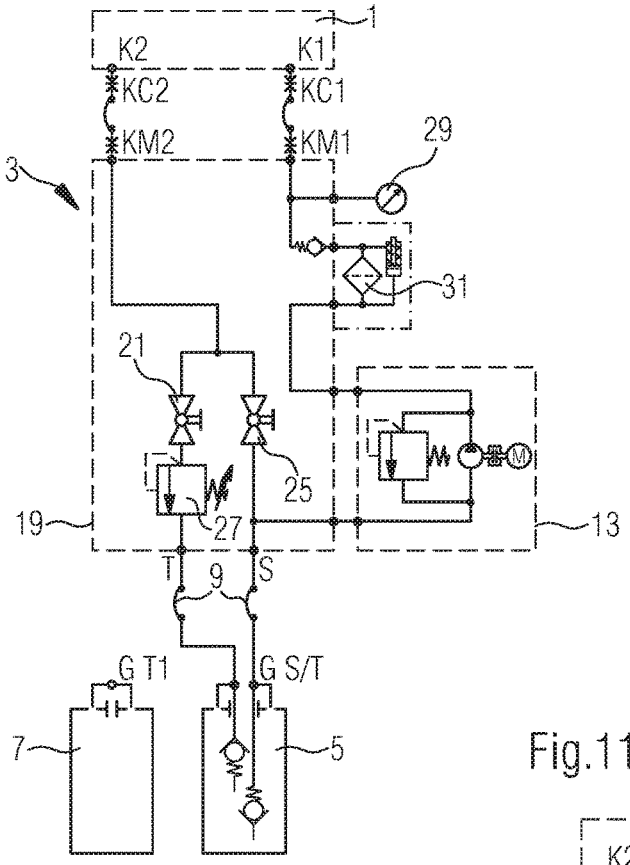
FIG. 10: Flushing module with two shutoff valves and bypass filtering functionality
Figure 11:
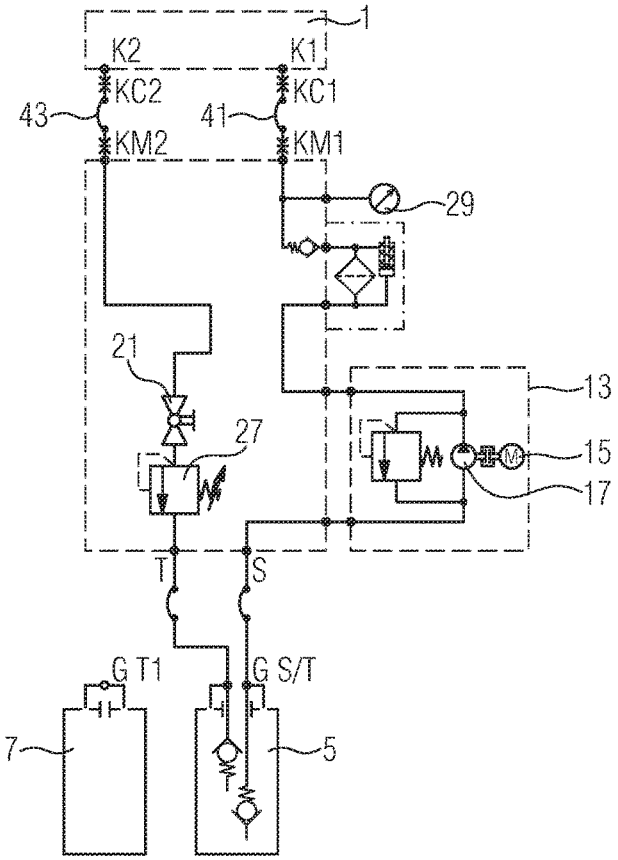
FIG. 11: Flushing module with only one shutoff valve

In FIGS. 9 to 11, variant embodiments of flushing modules are shown. In the flushing module 3 shown in FIG. 9, bypass filtering is not possible. This flushing module has only a first shutoff valve 21 and the third shutoff valve 25.

FIG. 10 shows an embodiment of a flushing module in which a hose connection T of the new oil flushing assembly 9 must be connected with the second hydraulic container after GT1, for draining waste oil. This hose connection of the new oil flushing assembly must next be connected to the first hydraulic container 5 and fitting GS. Bypass filtering is also possible with this flushing module 3. This flushing module 3 has only the first shutoff valve 21 and the second shutoff valve 23.

FIG. 11 shows a flushing module with only one shutoff valve. In this flushing module, as in the flushing module shown in FIG. 10, it is only possible to dispose of waste oil by changing the connection of the new oil flushing assembly 9 to the second hydraulic container 7. Bypass filtering is not possible. The process steps of bleeding, supplying fresh oil, flooding, flushing the fresh oil, and adjusting preload pressure may be carried out without restriction.

The process steps of preparing the flushing module, bleeding, coupling, uncoupling, preparing for storage and preparing the flushing module for transport and storage, relate to all the flushing module variants shown.

Flushing assemblies 9 and 11 have check valves 45 on their ends that protrude into the hydraulic container ends. These check valves are provided so that the flushing module, in particular the hydraulic lines of the flushing module, remain filled with hydraulic fluid during transport and also during container replacement and during storage. As a result, the process step of bleeding is limited, and the handling of the flushing module is more pleasant, because hydraulic fluid is prevented from leaking out.

Figure 12:
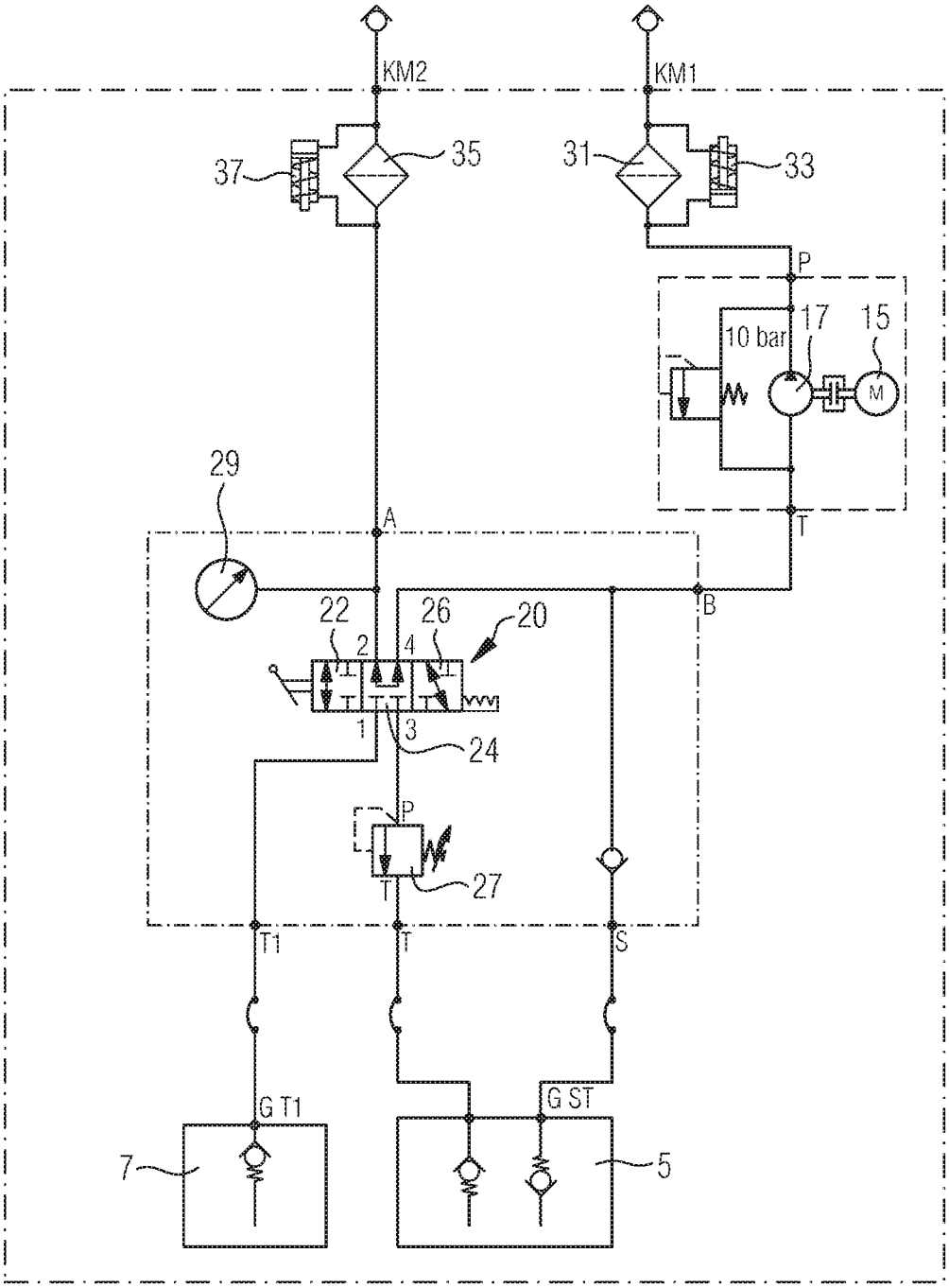
FIG. 12: Flushing module with a directional control valve as a shutoff valve
Figure 13:
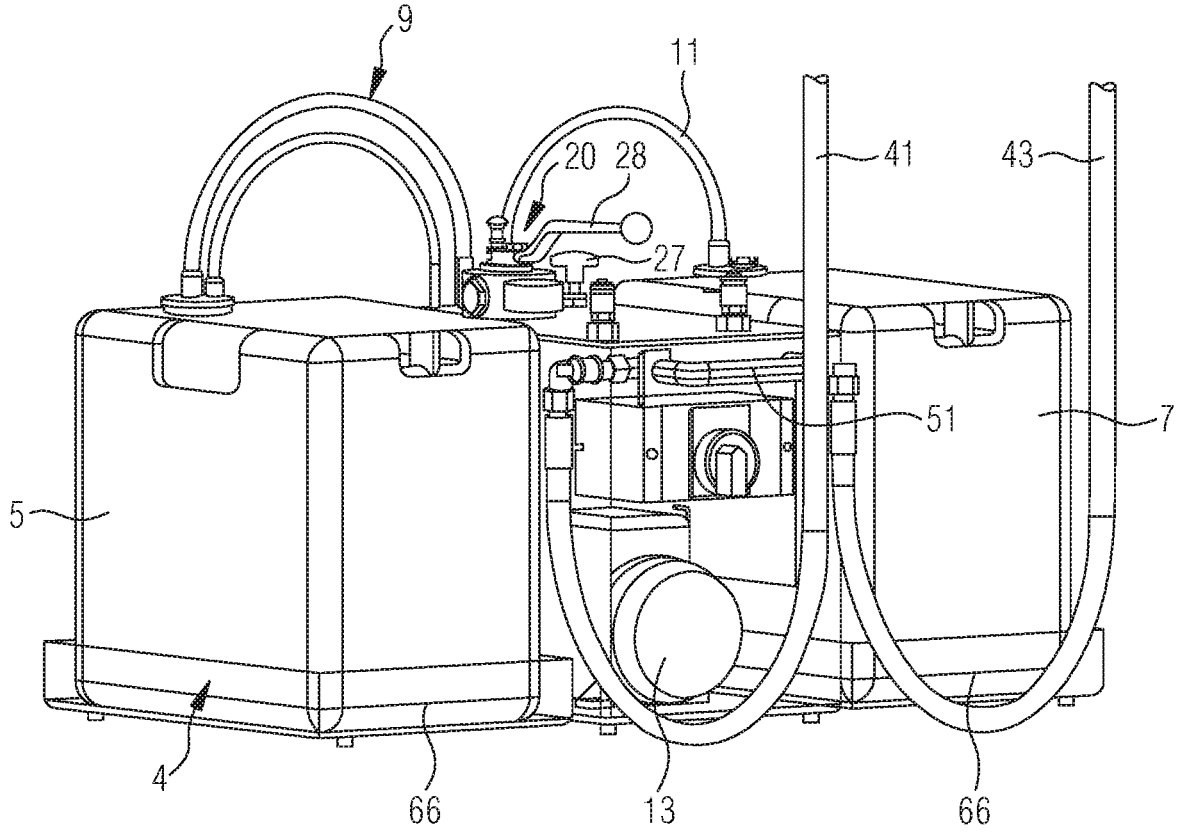
FIG. 13: Flushing module with foldable receptacles
Figure 14:
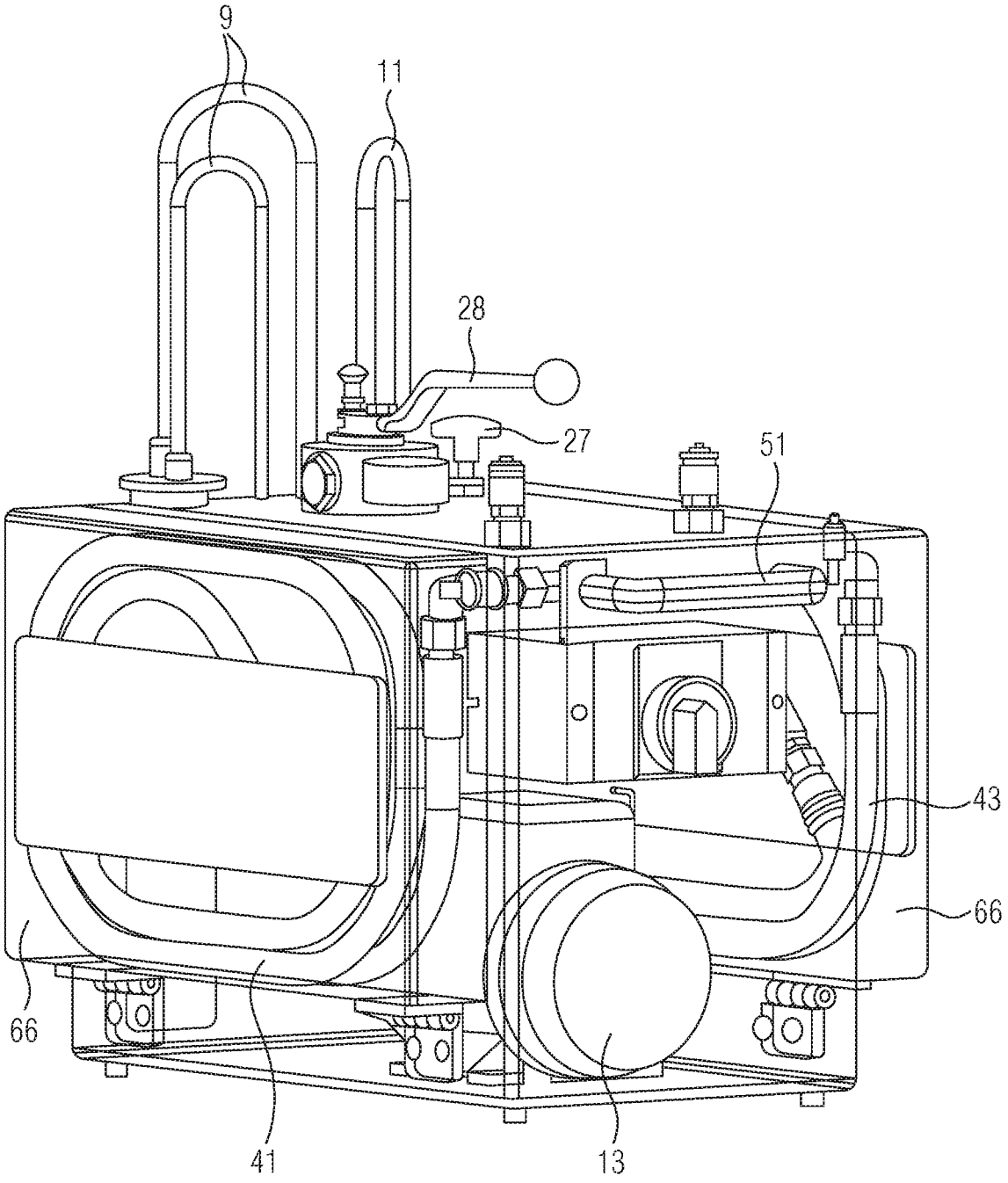
FIG. 14: Flushing module with hydraulic containers

FIGS. 12 to 14 show an additional embodiment. This flushing module 3 has a directional control valve 20 serving as shutoff valve 21, 23, 25. Specifically, a 4/3-way valve is used. The directional control valve 20 has three switching positions 22, 24, 26. In the case of switching into the first switching position 22, the process step "drain waste oil" is provided. "Drain waste oil" has already been described with reference to FIG. 7.

Figure 4:
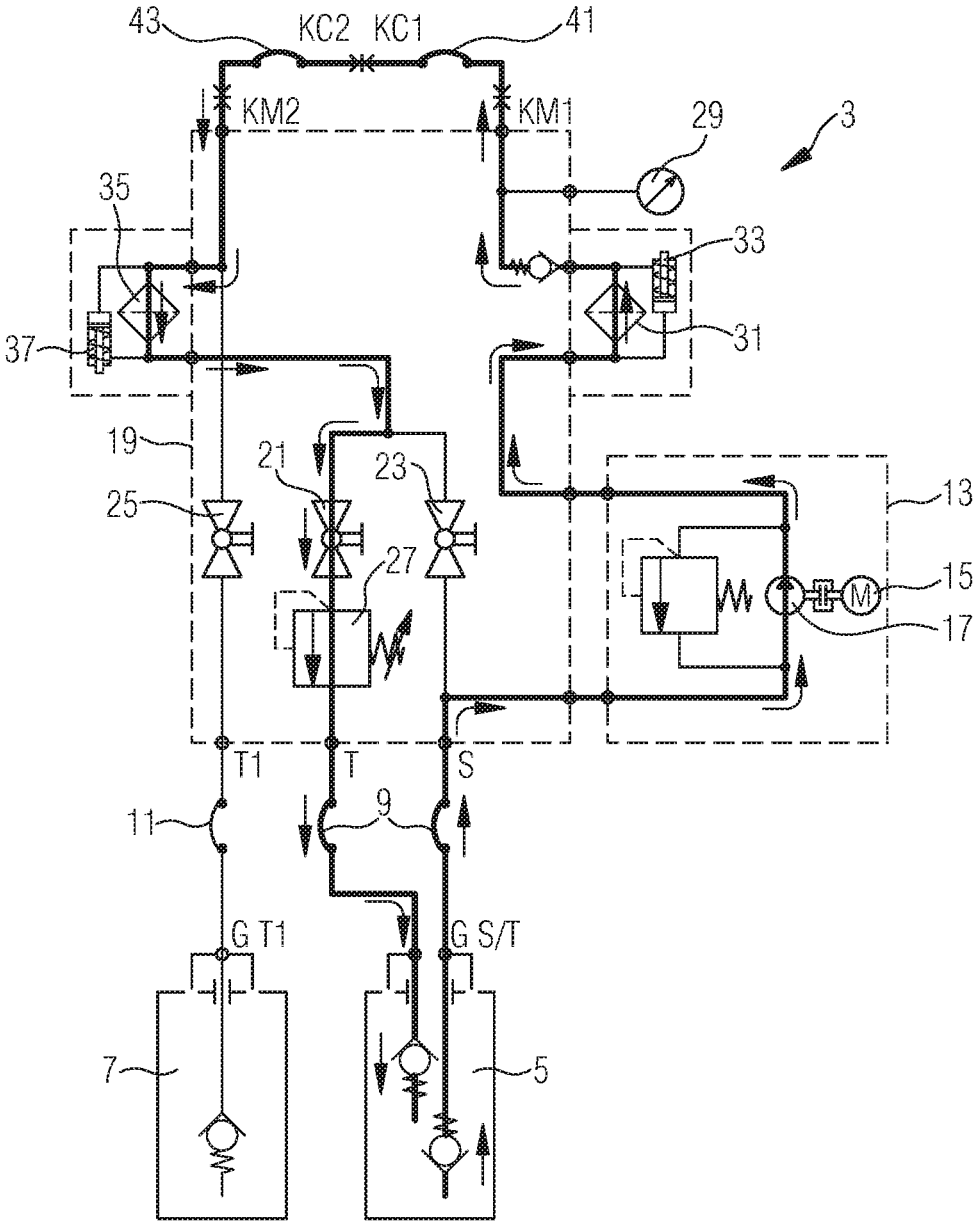
FIG. 4: Flushing module in "bleeding" operating mode
Figure 5:
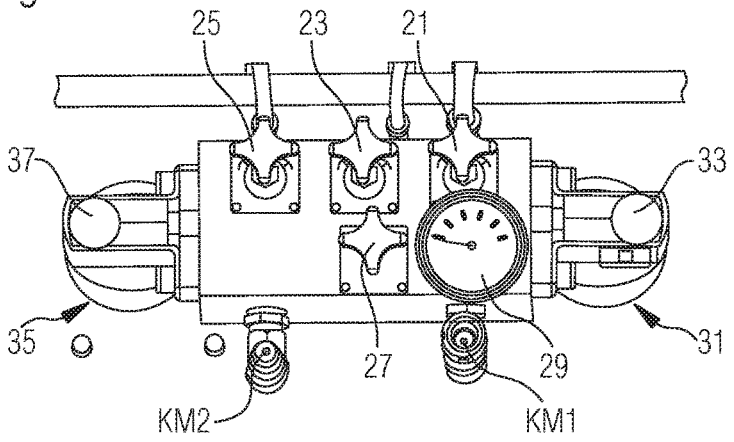
FIG. 5: View of the operating unit of the flushing module

With the second switching position 24, the "bypass filtering" function is provided. The "bypass filtering" function has already been described with reference to FIG. 6, With the third switching position 26, the functions "flooding fresh oil" as described with reference to FIG. 8, and "bleeding" as described with reference to FIG. 4, are provided.

FIGS. 13 and 14 depict a variant embodiment of the flushing module 3. In this embodiment, the housing 65 comprises foldable receptacles 66 that serve as a recess 4 for accommodating hydraulic containers 5, 7. The advantage of this variant is that the flushing module 3 is even more compact and easier to transport, due to its reduced external dimensions. Carrying handles 51 are formed on both sides of the housing 65. This makes carrying particularly straightforward. The hydraulic containers 5, 7 may only be put in place shortly before switching on the flushing module 3. In the exemplary embodiment shown, the hose connections for the inlet 41 and the return 43 are fixedly connected to the flushing module. The return 43 and inlet 41 are accommodated in a folded position within the foldable receptacles 66.

LIST OF REFERENCE SIGNS

1 Self-contained linear actuator
3 Flushing module
4 Recess for hydraulic container
5 First hydraulic container, new oil
7 Second hydraulic container, waste oil
8 Ventilation cover
9 Flushing assembly—new oil
11 Flushing assembly—waste oil
13 Motor-pump assembly
14 Valve, pressure protection
15 Motor
17 Pump
19 Valve-filter unit
20 Directional control valve
21 First shutoff valve, shutoff valve for external flush
22 First switching position of the directional control valve 20
23 Second shutoff valve, shutoff valve for internal flush
24 Second switching position of the directional control valve 20
25 Third shutoff valve, shutoff valve for oil change

26 Third switching position of the directional control valve 20
27 Pressure adjustment valve, pressure adjusting unit
28 Lever for adjusting the directional control valve
29 Pressure gauge, manometer
31 Filter in inlet
33 Inlet filter indicator
35 Return filter
37 Return filter indicator
39 Check valve
41 Inlet hose connection
42 Supply line
43 Return hose connection
44 Discharge
45 Check valves
51 Carrying handles
53 Cover
55 Main switch
57 Adapter
59 Accessory compartment
61 Accessories
63 Frame
65 Housing
66 Foldable receptacle
67 Housing base

The invention claimed is:

1. A method of replacing hydraulic fluid of a hydraulic drive, the method comprising:

providing a flushing module for hydraulic drives, for cleaning and/or replacing hydraulic medium, the flushing module having a pump, at least one shutoff valve and a housing configured to form a portable flushing module;

connecting the flushing module to the hydraulic drive;

draining the hydraulic fluid;

prior to connecting the flushing module to the hydraulic drive, bleeding the flushing module, by connecting hose connections intended for connecting to the hydraulic drive to the flushing module, and connecting to each other the hose connections at respective ends that are configured for connecting to the hydraulic drive, and connecting an inlet and outlet of the flushing module to an oil container that has been filled with new oil;

flooding the hydraulic drive by supplying fresh hydraulic fluid without preload pressure;

flushing the hydraulic drive by supplying fresh hydraulic fluid at a pressure below a predetermined preload pressure of the hydraulic drive;

adjusting the predetermined preload pressure; and disconnecting the flushing module.

2. The method according to claim 1, which comprises, during the flooding and flushing steps, connecting an inlet and an outlet of the hydraulic drive to the oil container via the flushing module.

3. The method according to claim 1, which comprises stowing the hose connections for connecting to the hydraulic drive in the flushing module after maintenance of filtering or replacing the hydraulic fluid has been performed.

* * * * *